United States Patent [19]

Kraver

[11] 4,241,487

[45] Dec. 30, 1980

[54] DISPOSABLE UNITARY SPLINE INSTALLATION TOOL

[76] Inventor: Richard A. Kraver, 8111 NW. 54th St., Miami, Fla. 33166

[21] Appl. No.: 7,504

[22] Filed: Jan. 29, 1979

[51] Int. Cl.[3] ..... B25B 27/14

[52] U.S. Cl. ..... 29/278; 140/109

[58] Field of Search ..... 29/278, 235, 270; 140/107, 109

[56] References Cited

U.S. PATENT DOCUMENTS

| | | | |
|---|---|---|---|
| 739,342 | 9/1903 | Peregrine | 140/109 |
| 2,661,487 | 12/1953 | Hicks et al. | 29/270 |

FOREIGN PATENT DOCUMENTS

| | | | |
|---|---|---|---|
| 63833 | 5/1955 | France | 29/270 |
| 64179 | 5/1955 | France | 29/270 |

*Primary Examiner*—James L. Jones, Jr.

*Attorney, Agent, or Firm*—Wolf, Greenfield & Sacks

[57] ABSTRACT

A disposable screen and spline installation tool for use to install screen material in a frame having a groove around one side edge which holds the screen peripherally with the aid of a retainer spline, the tool being a unitary body of elongate form having at a first end a first disc-like operator member with an arc-shaped edge which is convex in cross-section for forming a channel of the screen material in the frame groove, and at a second end a second disc-like operator member with an arc-shaped edge which is concave in cross-section for setting a spline into the channel.

4 Claims, 8 Drawing Figures

DISPOSABLE UNITARY SPLINE INSTALLATION TOOL

BACKGROUND OF THE INVENTION

This invention relates in general to framed screens intended for use in the windows and doors of people's homes to exclude crawling or flying insects, bugs and the like. In normal use the screening material, which typically may be made of thin strands of metal, plastic, or glass fibers, for example, and which is fragile, is easily damaged or detached from its frame, and when this happens the screening function is lost. For aesthetic reasons, including architectural beauty as well as maximum ventilation capability, it is desirable to make the frames of screens as thin as possible, and to maximize the area of window or door opening that is covered only by the screen material. This is especially true when sliding glass doors are installed in a home, and a sliding screen door is fitted to the opening for use when a door is left opened. The opportunity to poke a sharp object through the screen, or even for a person to walk through it, is sharply enhanced in that type of installation. The presence of little children or animal pets in a household further increases the opportunities to damage or destroy a screen, since children and animals do not reach for doorknobs—they almost always push on the nearest part of the door, and if it is the screen, damage easily results.

The almost universally-accepted form of frame-and-screen structure that is in use at the present time is a frame having a groove or channel along one edge for receiving and retaining the screen and a spline which holds the screen peripherally in the groove. In a typical screen installation, the screen is forced into the groove to form a mating channel for the spline, and then the spline is forced into place in the channel. This structure requires no tacks, and lends itself easily to stretching the screen across the frame opening. Professional screen installers, using wheel-type screen and spline installation tools can do neat installations fairly quickly with this kind of frame structure. This is illustrated in FIGS. 1 and 2 of the accompanying drawings, to be described below.

For the home owner, kits of screen material cut to convenient small sizes for standard window and door openings, and a supply of spline material, are available through convenient retail outlets, such as home-improvement and do-it-yourself stores, variety stores, drug stores, supermarkets and discount stores. Such kits, which are sold under brand names of the manufacturers who assemble and package them, are an economically sound response to the problems of screen maintenance and repair that confront the average home owner or occupant. Thus, a kit of screen parts and spline material suitable for replacing the screening in the frame of a window screen, may sell at retail for as little as $1.95. When one considers that under current economic conditions it will cost approximately $10.00 or more per hour for the services of a skilled tradesperson, including travelling time if necessary, the average householder is on practical economic grounds virtually compelled to maintain and repair screens on a do-it-yourself basis. However, a frustrating difficulty, to which up to now no manufacturer of do-it-yourself screen repair and replacement kits has provided a solution, is the fact that wheel-type screen and spline installation tools intended for non-professional use by householder-consumers are priced at retail in a range from about $1.50 each to about $10.00 each. This is too much to pay for a tool that may be used only once, or at most a few times. It is economically unsound to put the consumer in a position to have to pay as much or more for a tool to install a replacement screen, as the price of a kit of replacement screen materials.

GENERAL NATURE OF THE INVENTION

This invention provides a screen and spline installation tool at a cost so low that it can be supplied with a kit of replacement screen and spline materials with only little increase in the cost of the total kit. Each kit will have its own tool. The tool is disposable. It is capable of sufficient use to install the entire contents of the kit. The tool has no moving parts, and requires no hand-labor to make it. The material or materials of which the tool of this invention is made need only satisfy the economic goal of minimizing its cost and the functional goal of installing the screen parts that are in the kit with which it is furnished. It is of no concern to the invention that this tool may be worn out after it has satisfied that functional goal. The design of the tool of this invention is such that it provides the functional capability of a wheel or a roller without having a wheel or a roller in its structure; as is mentioned above, this tool has no moving parts.

In a preferred form, the tool of this invention is a unitary article made of a single piece of high-impact plastics material, such as styrene, by an automatic molding process which essentially eliminates hand labor. Preferably, this tool is of elongate form, each end of which is flattened into a disc-like shape having a curved edge. At one end, the edge is convex in cross-section. At the other end, the edge has a concave cross-section. These round edges resemble the edge contours of rollers as used in wheel-type tools, and they can be rolled over a spline or screen, for a part of the arc of a circle, to set the screen and the spline in a frame groove. In addition, the use of plastics material permits the convex edge to slide over the screen to set it in the groove, and permits the concave edge to slide over the spline to set it in the groove on top of the screen. The tool of this invention has, therefore, both the rolling capability of wheel-type tools without using separate wheels, and a sliding capability which is useful in a tool that can be permitted to wear out due to friction. The intermediate portion of this tool is integral with the flattened end portions, and is shaped to form a handle. The handle may have a generally flattened cross-section so that the entire tool is a generally flat, one piece article, which uses a minimum of plastics material, consistent with the goal of low cost and limited but adequate utility for the intended purpose. With a tool designed according to this invention, the cost-per-unit can be reduced by increasing the quantity produced in a given manufacturing operation, for example, by using a multi-cavity mold in a plastics molding operation. It is thus possible with the present invention to supply a disposable screen and spline installation tool to a do-it-yourself consumer for only a few pennies per tool. In this way it is possible to supply a kit of replacement screen and spline materials with a tool that is useful to install those materials, for a price very close to the price heretofore charged for the kit without a tool.

DETAILED DESCRIPTION OF THE DRAWINGS

Figure 1:
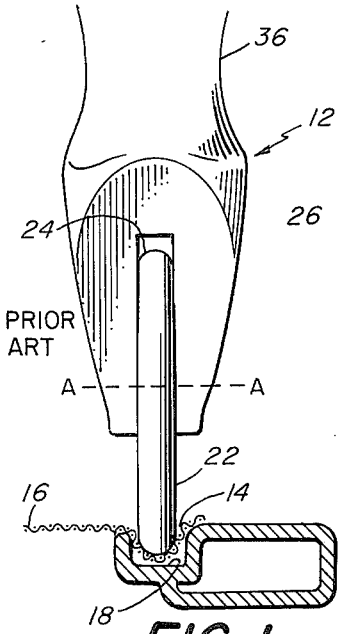
FIG. 1 illustrates a prior-art wheel-type screen installation tool in use to form a mating channel of a screen in a frame groove.
Figure 2:
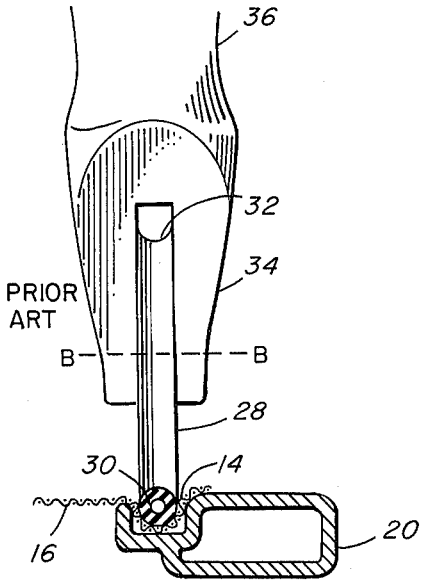
FIG. 2 illustrates a prior-art wheel-type spline installation tool in use to fix a spline in the mating channel formed in the screen with the tool of FIG. 1.

In FIG. 1, a part of a prior-art wheel-type roller tool 12 is shown in use to form a mating channel 14 of screen 16 in the groove 18 part of a frame 20, the frame being illustrated only in cross-section. The wheel 22 has a convex periphery 24 suitable for forming the mating channel 14, typical of wheel-type screen installation tools. The wheel 22 is supported in a fork 26 where it is rotatable on an axis A—A. Axial support means for the wheel are not shown, but it is noted that some of the more expensive tools include ball-bearing axle supports. FIG. 2 shows another wheel 28 in use for setting a spline 30 in the mating channel 14. The second wheel 28 has a concave periphery 32 matching the cross-sectional shape of the spline 30. Variations of or from this specific form are also known. The second wheel 28 is rotatably supported on an axis B—B in a fork 34.

The two forks 26 and 34 can be at opposite ends of the same handle 36. Thus, a typical screen and spline installation tool of the prior-art has at least two wheel-type components and means to support and mount each for rotation about its axis.

Figure 3:
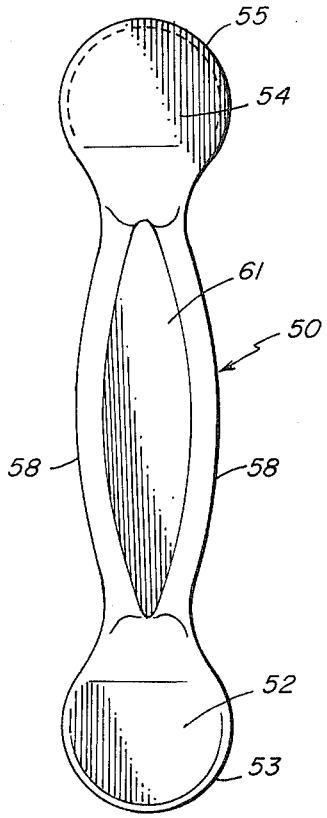
FIG. 3 is a plan view of a unitary tool according to the invention.
Figure 4:
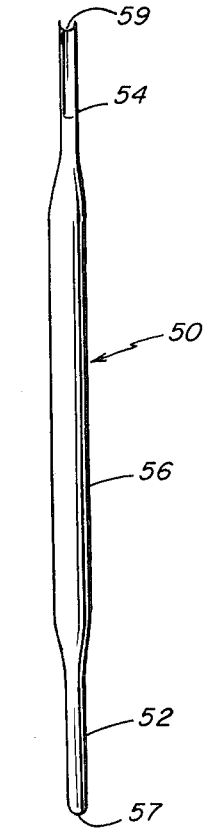
FIG. 4 is an edge-wise view of the unitary tool shown in FIG. 3.

A unitary screen and spline installation tool 50 according to the present invention is illustrated in FIGS. 3 and 4. This tool is made of a single body, preferably of a plastic material which can be formed in an essentially hand-labor-free process such as extrusion into a cavity mold. The tool 50 is of elongate form, each end of which is a flat disc-like shape 52, 54, respectively, having a curved edge 53, 55, respectively. At the first end 52 (lower end in FIGS. 3 and 4) the curved edge 53 has a convex cross-section 57. At the second end 54 the curved edge 55 has a concave cross-section 59. The intermediate portion 56 of this tool is integral with the flattened end portions 52, 54, and is shaped to provide a handle. The handle has a generally flattened cross-section, with edge ribs 58, 58 thicker than the inner portion 61, so as to minimize the quantity of material required. The ribs 58, 58 extend to each of the disc-shaped end portions 52, 54, completely surrounding the thinner inner portion 61. The illustrated tool is a unitary article which used a minimum of material, and hence has low weight, consistent not only with reducing the cost of producing it, but also with reducing the cost of shipping it.

Figure 6:
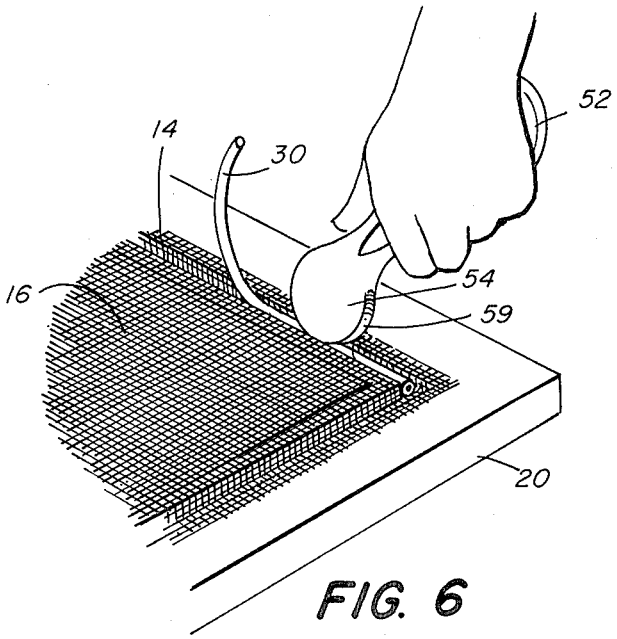
FIG. 6 shows the unitary tool in use to set a spline in the mating channel of the screen.
Figure 5:
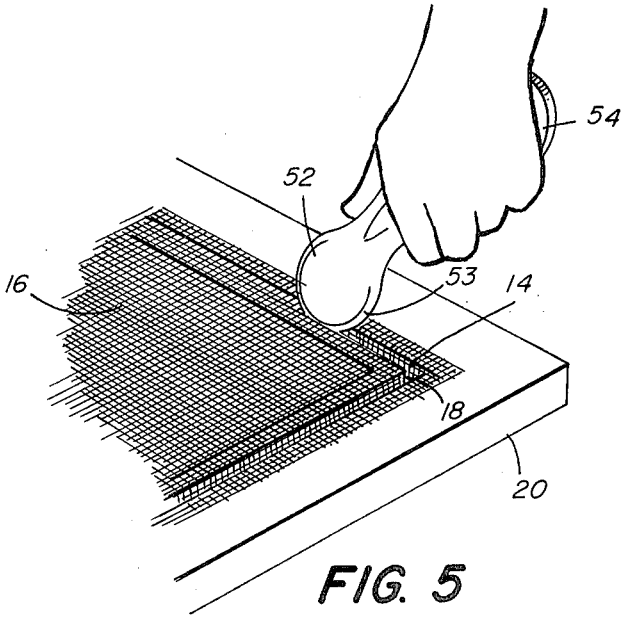
FIG. 5 shows the unitary tool in use to form a mating channel of screen in the groove of a frame.

FIGS. 5 and 6 illustrate the new unitary tool in use. In FIG. 5, the screen 16 and frame 20 of FIG. 1 are shown, with the convex curved edge 53 of the first end 52, in use to form a mating channel 14 in the screen over the frame groove 18. The curved edge 53 bearing the convex shape 56 can be rolled or slid over the screen to force the screen material into the frame groove 18, as will be described with reference to FIGS. 7 and 8 of the drawing. In FIG. 6 the second end 54 of the tool is used to set the spline 30 into the mating channel 14. The concave cross-section 59 guides the spline and forces it down into the channel 14. Again, the curved edge 55 bearing concave shape 59 can be rolled or slid over the spline 30, as will be explained.

Figure 7:
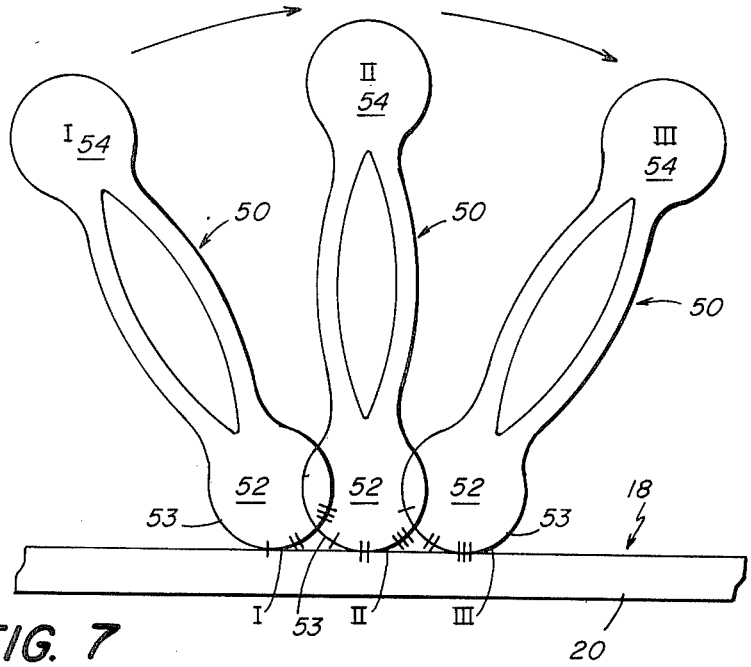
FIG. 7 illustrates a rolling mode of using the unitary tool.

Referring now to FIG. 7, the first end 52 of the unitary tool 50 is illustrated in rolling cooperation with the groove 18 in the frame 20. At position I the tool 50 is at an acute angle to the frame 20, and contact between the edge 53 and the frame is made at point 1. At position II the tool 50 has been rolled over the edge 53 to a position perpendicular to the frame 20, and contact is made at point 11 on the edge 53. At position III the tool has been further rolled over the edge 53 to an opposite angular position, and contact is made at point III on the edge 53. In moving from position I to position III by a rolling motion over the edge 53, the unitary tool of this invention has executed the same action on the screen 16 that a roller type tool of the prior-art would execute if rolled through the same arc length—i.e.: from point I to point III. The unitary tool can do this, moveover, without moving parts.

By repeating the mode of operation illustrated in FIG. 7, the unitary tool can be used to form the entire mating channel 14, and to set the entire spline 30 (see FIG. 6), with a rolling motion similar to that of a wheel-type tool. In channel 14 is being formed, and this will cause wear on the edge 53, which can be minimized by using the rolling mode of FIG. 7 to start the channel, and occasionally to form a subsequent portion of the channel if friction or resistance appears to be increasing. Wear can also be shifted from one portion of the edge 53 to another by changing the angle between the tool 50 and the frame 20, and by reversing the tool around its long axis C—C, so as to shift to another contact point 74 on the edge 53.

Figure 8:
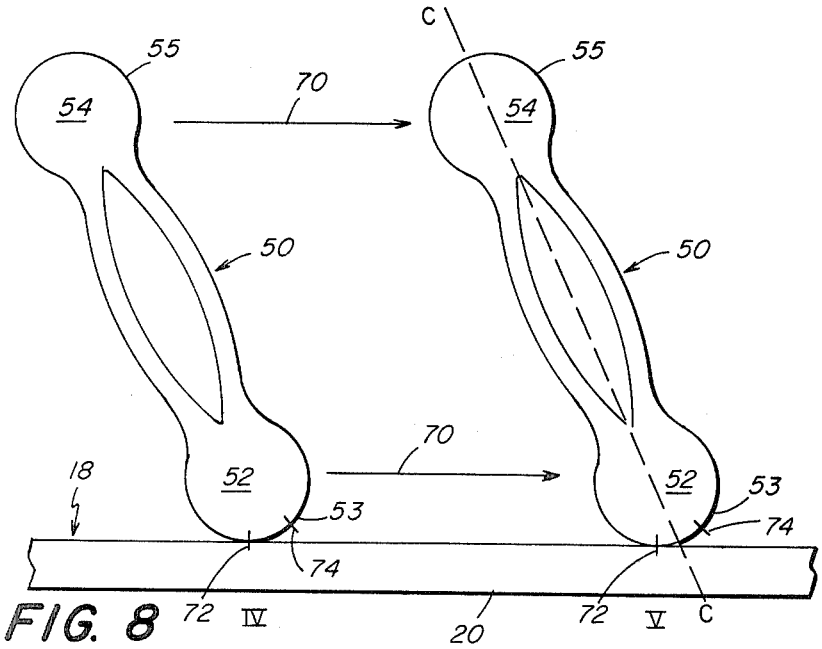
FIG. 8 illustrates a sliding mode of using the unitary tool.

When the second end 54 of the tool is being used to set a spline 30 into the channel 14 the rolling mode of FIG. 7 can be used to start the spline into the channel, and then the sliding mode of FIG. 8 can be used to continue. If sliding friction can be held small, as is more likely in the case of setting in a spline than in the case of forming the mating channel 14, the sliding mode may be preferred because it will go faster than the rolling mode of using this unitary tool.

As has been explained in the introductory portion of this specification, the tool of this invention is intended to be disposable, and the fact that it will be permitted to wear out when used is consistent with the purpose of the invention. However, with careful use as has been described, the life of this tool can be extended, if desired.

I claim:

1. In the art of installing screen material in a frame which bounds an opening to be screened against insects and the like, said frame having a groove peripherally bounding the opening for receiving and retaining the peripheral part of a piece of screen material that spans the opening, and a spline which holds the peripheral part of the screen material fixed to the frame in the groove, a unitary disposable combination screen and spline installation tool intended to be supplied with a limited quantity of screen repair material for use to install said peripheral part of said piece of screen material in said groove and said spline into said groove on top of said screen material, said tool comprising a unitary body of substantially flat elongate form having at a first end a first disc-like operator member with an arc-shaped edge which is convex in cross-section for pressing said peripheral part of said screen material into said groove and thereby forming a mating groove in said screen material, and at a second end a second disc-like operator member with an arc-shaped edge which is concave in cross section for pressing said spline into said mating groove and thereby fixing said peripheral part of said screen material into said frame for holding said screen material in place across said opening, and between said operator members a part of said body shaped as a handle, said first and second operator members being non-rotatively affixed to said handle so as to allow only frictional or limited rotational contact with said peripheral part of said screen material and with said spline, respectively, whereby during use said tool will be subjected to wear, said tool being made of a material which can be expected to wear out under frictional contact encountered in use to install said quantity of screen repair material.

2. A tool according to claim 9 which is made of a single piece of a plastics material.

3. A tool according to claim 2 in which the plastics material is a high-impact styrene.

4. A tool according to claim 2 in which the handle portion has edgewise ribs that are thicker than the intermediate portion, each rib extending at its respective ends into one of said operator members, for providing strength with reduced use of plastics material.

* * * * *